United States Patent [19]

Bovay

[11] Patent Number: 4,756,276

[45] Date of Patent: Jul. 12, 1988

[54] DEPARTURE GATE FOR RACES

[75] Inventor: Jean-Pierre Bovay, Bienne, Switzerland

[73] Assignee: Omega Electronics S.A., Bienne, Switzerland

[21] Appl. No.: 869,536

[22] Filed: Jun. 2, 1986

[30] Foreign Application Priority Data

Jun. 3, 1985 [FR] France ..... 85 08439

[51] Int. Cl.[4] ..... G04F 9/00

[52] U.S. Cl. ..... 119/15.5 A

[58] Field of Search ..... 119/15.5, 20, 155, 15.5 R

[56] References Cited

U.S. PATENT DOCUMENTS

Re. 22,203 10/1942 Bosio et al. ..... 119/15.5
2,559,796 7/1951 Rath ..... 161/18
3,854,451 12/1974 Mackey ..... 119/15.5

FOREIGN PATENT DOCUMENTS 2245529 3/1973 Fed. Rep. of Germany .

OTHER PUBLICATIONS

La Suisse Horlogere et Revue International de L'Horlogerie, vol. 83, No. 3, Sep. 1968, pp. 33–40; "Aux Jeux Olympiques d'Hiver de Grenoble: Le Chronometrage Integral".

*Primary Examiner*—David A. Scherbel
*Assistant Examiner*—Caroline D. Dennison
*Attorney, Agent, or Firm*—Griffin, Branigan & Butler

[57] ABSTRACT

A departure gate for sporting runs includes two riser members forming an outlet, each riser member bearing a device comprising a bar arranged to be angularly movable, the bar extending at least halfway over the width of the outlet. Each device includes an electrical contractor controlled by the bar and operated thereby as soon as the bar has traversed a predetermined angle ($\alpha$). The contactors are coupled in a manner such that an electrical output signal is produced only when at least one of the bars has traversed the angle $\alpha$. The gate minimized or eliminates the influence that the starting position of the contestant may have on his result.

20 Claims, 3 Drawing Sheets

DEPARTURE GATE FOR RACES

This invention concerns a departure gate for sporting runs comprising an outlet formed by two risers arranged on either side of the track used by a runner and placed on the departure line and contact means producing an electrical signal for starting a chronograph when the runner crosses said departure line.

BACKGROUND OF THE INVENTION

Such a gate is well known from the state of the art and regularly employed in sporting disciplines such as alpine skiing, cross-country skiing, canoeing or again cross-country running. It may appear as shown in FIGS. 1 and 2. FIG. 1 is a perspective view of a known type of gate. It comprises an outlet formed from two risers 1 and 2 arranged on either side of the track 3 used by the runner and placed on the departure line 4. The gate is provided with contact means which will produce an electrical signal when the runner crosses the line 4. To this effect it comprises a device 5 fixed on the riser 2. A bar 6 is hinged onto device 5. Bar 6 controls an electrical contactor (not shown) mounted in the device 5. When pushed by the runner, bar 6 pivots in the sense of arrow 7 and when it has traversed an angle of around 30°, operates a contact provided within the contactor. The activation of this contact starts an electronic chronograph which counts the elapsed time between the moment of opening of the bar until the moment when the runner crosses the finish line.

This simple system presents however a serious difficulty which is that of causing the starting of the chronograph to depend on the position of the runner at the moment of departure from whence there may result different times according to the position chosen. In order to explain this, reference is made to FIG. 2 which shows a top view of the gate according to the prior art and which employs the same references as those employed on FIG. 1. The bar here is shown in the closed position 6 where it is aligned along the departure line 4 and in an intermediate position 6' for which the opening angle $\alpha$ is of 30°. For this opening angle, the contactor controlled by bar 6 is activated and the chronograph begins to count. To bring the bar from the position 6 to the position 6', one may act at 8 close to the hinge or at 9 at the opposite end. If one acts at 8, the figure shows that a very small displacement a is necessary to bring the bar from the position 6 to the position 6' while if it is at 9 that one acts, there will be required a much greater displacement b in order to obtain the same opening angle. This being the case, it is understood that the runner shown at 10 on figure 2 will have every advantage to place himself as close as possible towards the left of the figure and even in this position, to advance his right knee since in these conditions he may cross a distance b before the chronograph begins to count. Thus of two runners moving at the same speed over the same distance, one leaving at 8 and the other at 9, it is the one who will have left at 9 who will win the race.

If one designates by t the average time taken by a runner to cover a distance designated by L, by b the distance traversed before starting of the chronograph, the time gain t' will be:

$$t' = t \cdot b / L$$

According to the type of course envisaged, this time gain is not negligible. In order to be convinced thereof, one may take an example drawn from a ski race of the slalom type. The competition is run over a length of about 600 meters and has an average duration for each skier of around 86 seconds. The outlet of the gate has a width of 0.75 meters between the riser 1 and 2. FIG. 2 being drawn at the scale 1/10, it is seen that if the push takes place at 9, the distance b crossed is on the order of 0.3 m (while such would be only of 0.04 m if the push had been given at a). One may thus, by applying the above formula, estimate the time gain t' at $$t' = 86 \cdot 0.3 / 600 = 0.04 \text{ second.}$$

This value may be considered as a minimum since it does not take account of the fact that the skier starts from a stopped position. Various practical measures have shown that the time gain considered may be situated between 0.04 seconds and 0.1 second. When one realizes that presently the classification of competitors depends on hundredths of a second, it will be undersood that there is a need to eliminate or at least to minimize as far as possible the advantage which one competitor may have over another based only on the manner of departure, whether this advantage be intentionally sought or not.

It is conceivable that this advantage may vary in considerable proportions. It is going to depend essentially, as has been seen, from the position taken by the runner at the departure but may also depend on other factors such as for instance width of the outlet between the risers 1 and 2.

SUMMARY OF THE INVENTION

Thus, with the objective of overcoming considerably the difficulties mentioned, the present invention comprises a departure gate for sporting runs including an outlet formed by two risers members arranged on either side of the track used by a runner and placed on the line of departure, and contact means producing an electrical signal for starting a chronograph when the runner crosses said line of departure, each riser bearing a device including a bar arranged to move angularly when pushed by the runner from a closed position aligned with the line of departure to an open position in the sense of the course, the length of the bar extending at least halfway over the width of the outlet, said device further comprising an electro-mechanical contactor controlled by the bar and operated as soon as said bar has traversed a predetermined angle $\alpha$.

DESCRIPTION OF THE PREFERRED EMBODIMENT

Figure 1:
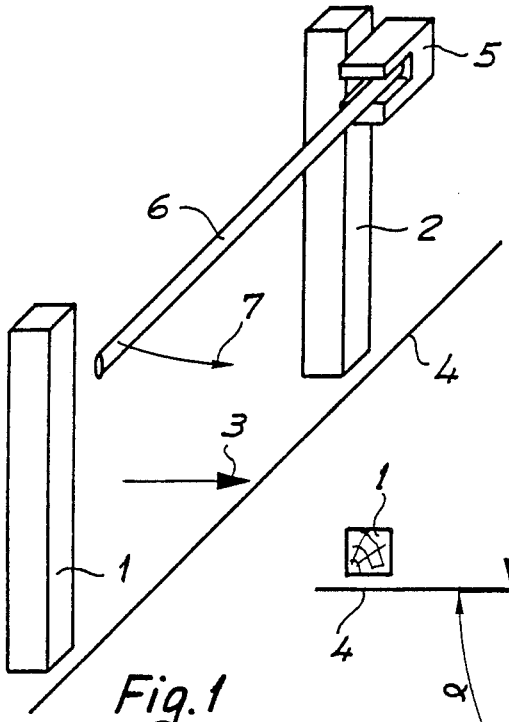
Fig.1 PRIOR ART
FIG. 1 is a perpective view and FIG. 2 a top view of a departure gate according to the prior art previously discussed.
Figure 2:
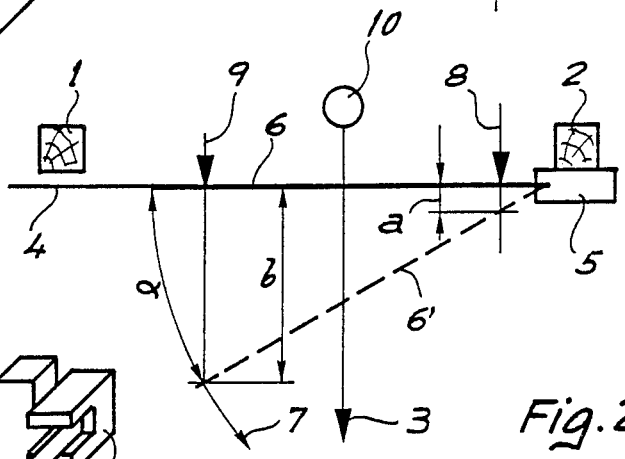
Figure 3:
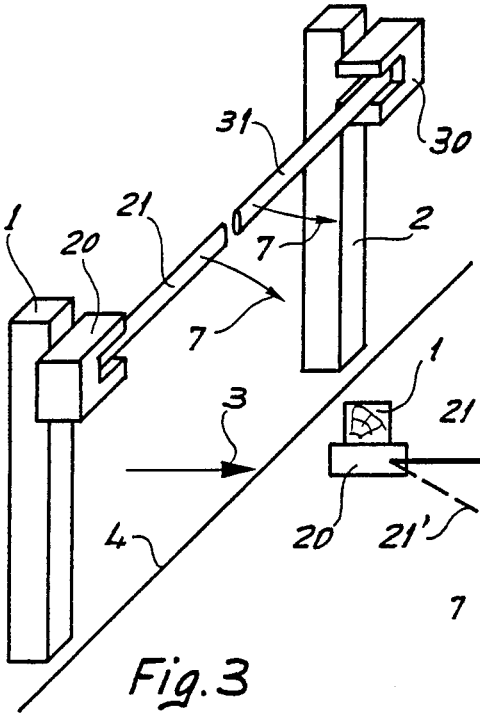
FIG. 3 is a perspective view illustrating the principle of the gate according to a first form of the invention.

FIG. 3 shows a first form of the gate according to the invention. This gate comprises two risers 1 and 2 each of which bears a device similar to that described in respect of FIGS. 1 and 2. Device 20 comprises thus a bar 21 capable of being angularly displaced from a closed position in which it is shown to an open position in the sense of arrow 7. Here the length of the bar 21 extends over at least half the width of the outlet defined by the distance existing between the risers 1 and 2. The device 20 comprises likewise an electro-mechanical contactor (not shown) controlled by the bar and activated when said bar has traversed a predetermined angle. A schematic of the principle of this contactor will be described further on. In an analogous fashion, the riser 2 bears a device 30 on which is hinged a bar 31 connected in turn to an electro-mechanical contactor. The bar 31 extends at least over half the width of the outlet of the gate. The track and the direction of the runner are symbolized by arrow 3 while the departure line is shown by line 4.

Figure 4:
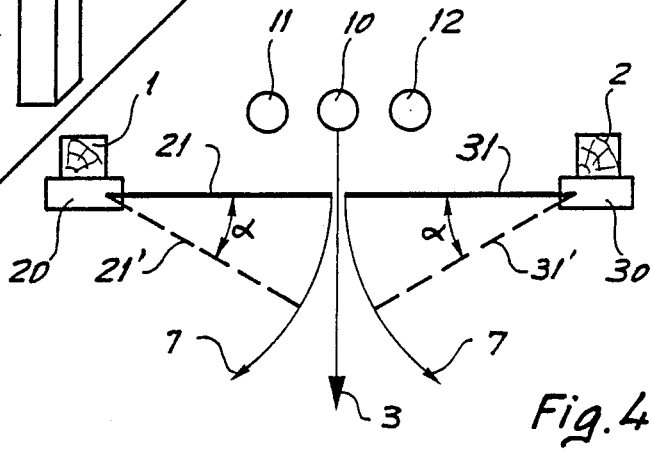
FIG. 4 is a top view to explain the operation of the gate shown on FIG. 3.

FIG. 4 is a top view of the gate illustrated on FIG. 3 where the same references are employed. The bars are represented in closed positions 21 and 31 where they are aligned along the departure line 4 and in intermediate open positions 21' and 31' for which the respective contactors have been activated. Between these two positions a predetermined angle $\alpha$ exists, chosen preferably to be 30°.

According to one form of the invention and as will appear in the schematics explained further on, the contactor mounted in the device 20 and that mounted in the device 30 are electrically coupled together in a manner such that the electrical signal which is to start the chronograph is produced only when bars 21 and 31 will have each traversed the predetermined angle $\alpha$. This device is similar to an electronic AND-gate where an output signal is obtained only if both inputs are at a logic 1 level (the same reasoning applies but inverted for a NAND-gate).

One may immediately see the interest in a gate according to the description which has just been given. A runner 10 launching himself along track 3 will have to operate both bars 21 and 31 through at least a predetermined angle $\alpha$ in order to start the chronograph. Thanks to this arrangement, the position of the runner at the departure has much less influence on the result obtained than it would otherwise have using a gate with a single bar. Effectively, if reference is again had to FIG. 4, it is seen that the gate according to the invention provides a central axis of symmetry 3. In this figure, there have been shown two runners at different departure positions. The first has the axis of the body 11 displaced to the left of the axis of symmetry 3. The axis of the body 12 of the second is displaced to the right of this same axis of symmetry. With equivalent behaviour, it will be understood that the distance traversed by one or the other runner is equal at the moment when the chronograph is started. The same obtains for a runner the axis of whose body 10 coincides with the axis of symmetry and who at the departure on one occasion would advance the left knee and on other other occasion the right knee: the result obtained would be similar.

Figure 5:
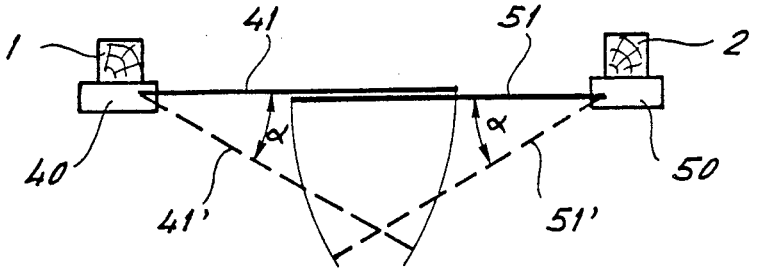
FIG. 5 is a variant of the form of invention shown on FIG. 4.

The gate shown on FIGS. 3 and 4 employs a double bar 21 and 31. Each of these bars has a length extending over the half of the length of the outlet. In order to operate correctly, this gate will require a width of outlet which exceeds only slightly the space necessary to allow the runner to pass. Otherwise one of the bars may not open sufficiently and not actuate the corresponding contactor. It may be estimated that this width should not exceed 0.5 m. However, if it is desired to maintain a normal width which is on the order of 0.75 m while assuring a correct operation of the starting of the chronograph, one may employ a gate as shown on FIG. 5. Here each of the devices 40 and 50 otherwise similar to that which has been described above bears a bar 41 and 51 respectively, each of these bars extending over more than half the width of the outlet. One may thus be certain that each of the bars will be sufficiently opened (at least to the amplitude $\alpha$) in order to actuate the contactors of the devices 40 and 50.

Figure 6:
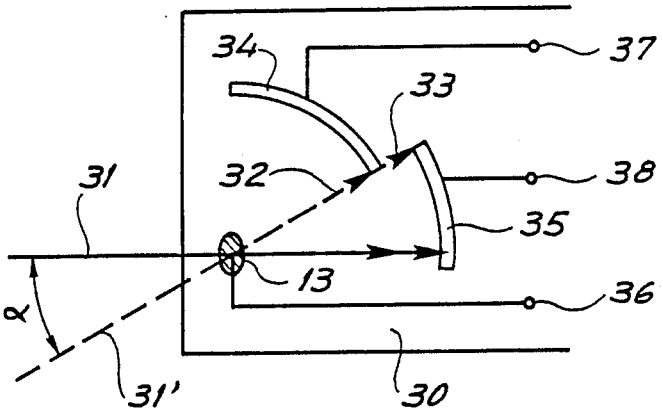
FIG. 6 shows an arrangement for carrying out the principle of the electrical contactor controlled by the bar of the gate.

FIG. 6 shows a possible arrangement of the electro-mechanical contactor contained in each of the devices 20, 30, 40 and 50. Here the bar 31 is shown pivoting at 13 on the device 30. It is shown at the closed position 31 and then the intermediate opened position 31' for which the contactor is actuated. The end of the bar bears a double cursor 32 and 33 first making contact with a track 35. Tracks 34 and 35 may be conductive strips of a printed circuit. The double cursor 32 and 33 constitutes the common terminal 36 of the contactor. Terminals 37 and 38 of the contactor are coupled respectively to the conductive strips 34 and 35.

When the opening angle of the bar is less than $\alpha$, the terminals 36 and 38 are short-circuited. When this opening is greater than $\alpha$, terminals 36 and 37 are short-circuited. The angle $\alpha$ is that for which the contactor is actuated.

It is evident that many other contactors systems could be employed to fulfil the same function. For instance, one could employ a micro-switch with opening and closing contacts as well as a system similar to that found in electro-magnetic relays.

Figure 7:
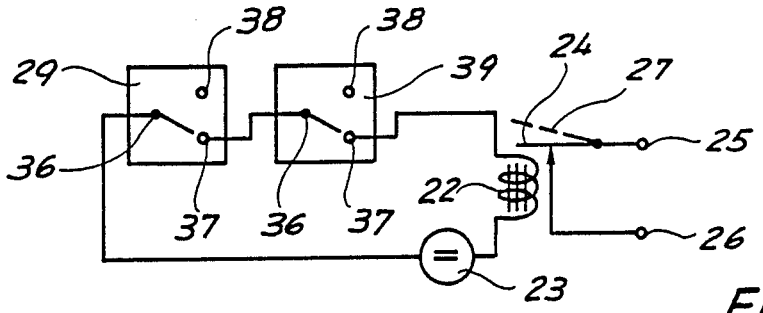
FIG. 7 is a schematic showing the two electrical contactors of the gate of FIG. 3 coupled in series.
Figure 8:
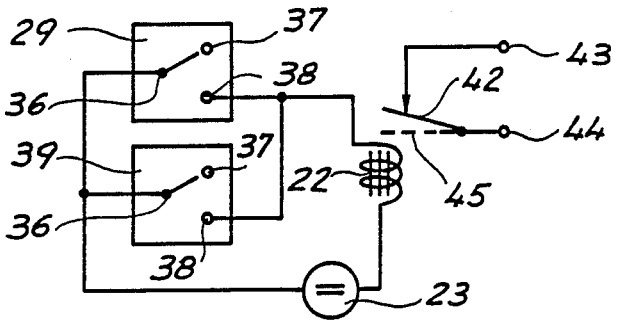
FIG. 8 is a schematic showing the two electrical contactors of the gate of FIG. 3 coupled in parallel.

As has already been mentioned, according to one form of the invention the electro-mechanical contactors, one per device, are electrically coupled together in a manner such that the electrical signal is produced only when the respective bars have both traversed the predetermined angle $\alpha$. Two possible schematics of connections are shown in FIGS. 7 and 8 where contactors 29 and 39 are those mounted respectively in the devices 20 and 30. In the two figures, terminals 36, 37 and 38 are those which have been described vis-à-vis FIG. 6 and the contactors are all shown in an actuated position.

In FIG. 7, contactors 29 and 39 are arranged in series. When they are actuated, each presents a closed contact 36, 37. A relay 22 is then operated by a DC source 23 to move its armature into position 24. Terminals 25 and 26 are short-circuited so as to produce an electrical signal serving to start a chronograph. When the contactors are not actuated, terminals 36 and 38 of contactors 29 and 39 are coupled together and the armature of the relay 22 remains in position 27. No electrical signal is produced on terminals 25 and 26. The schematic likewise shows that both contactors must be on terminal 37 in order that the armature be positioned at 24.

In FIG. 8, contactors 29 and 39 are arranged in parallel. When they are actuated, each presents an opened contact 36, 38. Relay 22 is not energized by source 23 and the relaxed armature is at position 42. Terminals 43 and 44 are then short-circuited to produce an electrical signal serving to start the chronograph. In the same manner, when the contactors are not actuated, terminals 36 and 38 of contactor 29 and 39 are coupled together and the armature of the relay 22 is shifted to position 45. No electrical signal is produced on terminals 43 and 44. The schematic also shows that both contactors must be on terminal 37 in order that the armature be positioned at 42.

It may be mentioned relative to FIGS. 7 and 8 that the circuit on which the contactors 29 and 39 act could comprise a system of switching other than that of relay 22. One could thus for instance employ a bistable flip-flop. It is noted also that in most cases source 23 and relay 22 will not be at the gate but in a control cabin which will also include the chronograph. This chronograph of the electrical type is of a well-known type and will not be described here. It is reset to zero at the beginning of the course and begins to count the time interval from the moment the signal is provided by relay 22, i.e. as soon as terminals 25 and 26 have been short-circuited or terminals 43 and 44 which are likewise input terminals for the chronograph.

In addition to the advantage already explained hereinabove for giving each of the competitors results which are essentially independent of their departure positions, the gate of the invention likewise avoids that false information be transmitted to the control cabin. Effectively, it may occasionally happen that before the effective departure, the runner operates one of the bars by inadvertence by means of one of the ski poles for instance. In the prior art gate having a single bar, this movement often leads to starting the chronograph. Such will be far less often the case with the gate according to the invention since such an inadvertent movement would have to operate both bars at the same time.

Figure 9:
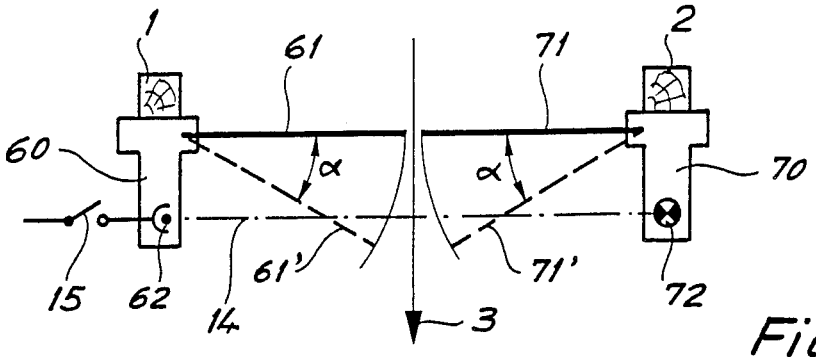
FIG. 9 is a top view of the gate according to a second form of the invention.

FIG. 9 is a top-wise of the departure gate according to a second form of the invention. It is distinguished basically from the first form by the fact that it comprises a luminous barrier in addition to the electro-mechanical contactors already mentioned. On risers 1 and 2 are respectively fixed devices 60 and 70 each of which contains an electrical contactor (not shown), one being controlled by bar 61 and the other by bar 71. The device 70 further comprises a luminous source 72 and device 60 a photo-electric cell 62 in order to form barrier 14. The barrier 14 is placed after bars 61 and 71 in the sense 3 of the course. The distance between the barrier and the bars is chosen in a manner such that the runner cuts the light beam only after having actuated the contactors contained in devices 60 and 70. The cell 62 actuates in a known manner a contactor referred to as the photo-electric contactor and which is schematically shown at 15 on FIG. 9. Contactor 15 may be a monostable multivibrator which is actuated at the moment when the barrier is cut, then reset after a lapse of time determined by a time constant.

This second form of the invention improved substantially the performance of the departure gate in respect of the first form since it absolutely suppresses any advantage which could still subsist according to the first method and which would bring an advantage however small to one competitor relative to another. In the departure gate of FIG. 9, it is crossing the barrier which provides the final step in starting the chronograph. Effectively, as may be seen on FIG. 6, as soon as bar 31 is open, i.e. when it has traversed angle $\alpha$, the contactor remains actuated. It is the same for the contactor actuated by bar 21. As will be seen in respect of FIGS. 10 and 11, the photo-electric contactor and the electro-mechanical contactors are coupled together in a manner such that the electrical starting signal of the chronograph is produced only when the electro-mechanical contactors and then the photoelectric contactor have been successively actuated. There results therefrom that the starting signal is produced upon crossing the barrier inasmuch as the contactors connected to the bars have been previously actuated.

One might pose the question as to why a simple luminous barrier would not suffice, whether it concerned a gate with a simple bar according to the piror art or the gate with a double bar according to the invention but in such instances without electrical contacts. Such a solution is however not satisfactory for it frequently gives rise to the emitting of starting signals which do not correspond to the real departure of a competitor. Effectively, in ski competitions for instance, the competitor in the departure position has the habit of placing his ski poles in front of the bar and may readily interrupt the luminous beam without such being intentional. In the recommended arrangement of the second form of the invention, the luminous barrier is potentially enabled only when the bars have traversed angle $\alpha$, i.e. only when the competitor has started. In other words, the barrier is active only in a narrow time slot situated immediately following the opening of the bars.

Following the same idea, it could be sufficient to employ the luminous barrier together with a contactor connected to the single bar of the gate according to the prior art. In this case however, it will be necessary to place the barrier very much ahead of the departure gate which would render impractical its integration with the device attached to the riser. However, a barrier which is independent from the departure gate is undesirable since it may fall, be hooked by the competitor and above all not be positioned exactly relative to the departure gate.

Figure 10:
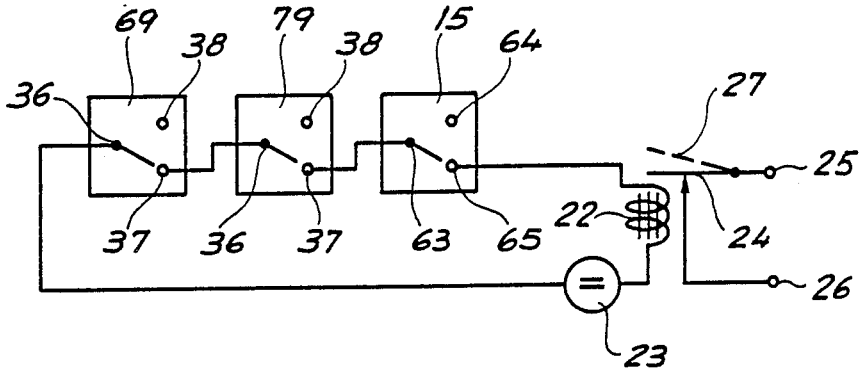
FIG. 10 is a schematic showing the two electro-mechanical contactors and the photo-electric contactor of the gate of FIG. 9 coupled in series.
Figure 11:
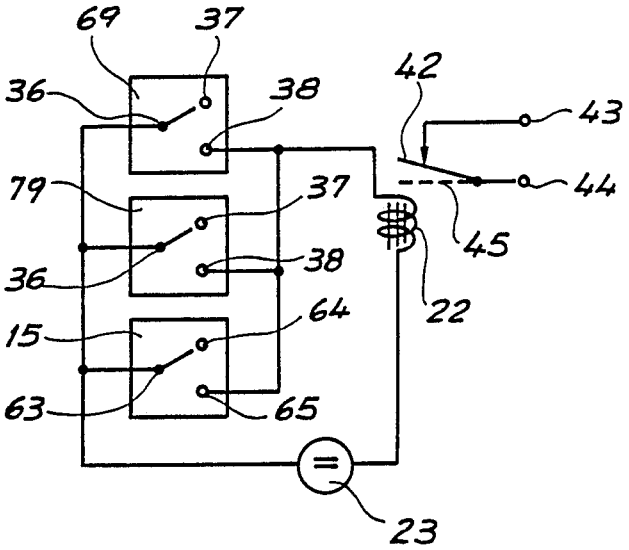
FIG. 11 is a schematic showing the two electro-mechanical contactors and the photo-electric contactor of the gate of FIG. 9 coupled in parallel.

Two possible connection schematics of the second form of the invention are shown in FIGS. 10 and 11. Contactors 69 and 79 are electro-mechanical contactors mounted in the corresponding devices 60 and 70 of FIG. 9. They are of the type described with reference to FIG. 6. Contactor 15 is the photo-electric contactor described relative to said FIG. 9. When the luminous barrier is unbroken, the contact is between terminals 63 and 64. When the barrier is cut, contact takes place between terminals 63 and 65. All the contactors are shown in the actuated position.

In FIG. 10 contactors 69, 79 and 15 are arranged in series. The operation of the circuit has been described relative to FIG. 7 and will thus not be repeated in detail here. It will be sufficient to note that the two electrical contactors 69 and 79 must be positioned 36–37 and that the electro-optical contactor must be positioned 63–65 in order that the armature occupy position 24 following which the chronograph is started.

In FIG. 11, contactors 69, 79 and 15 are arranged in parallel. It will be sufficient likewise to note relative to this figure that contactors 69 and 79 must assure the connection 36–37 and contactor 15 must connect 63–64 in order that the armature occupy position 42 at which the chronograph is started.

In one schematic as in the other, it will be seen that if the luminous barrier is cut (contactor 15) without the contactors 69 and 79 being actuated, the system will produce no output and thus corresponds to a logic gate with three inputs and one output.

According to the preceding description, the electrical contactors 29 and 39 are coupled together in a manner such that the electrical signal starting the chronograph is produced only when bars 21 and 31 have both traversed angle $\alpha$. Another form is possible in which the electrical contactors are coupled together in a manner such that the signal starting the chronograph is produced as soon as one of the bars has traversed said angle. This solution which however is less sure, may be envisaged when the departure gate includes a central symmetry axis in a manner such that by equivalent behaviour of the competitor on either side of this axis, the distance traversed is equal at the moment when the chronograph is started. Under these conditions the schematic of FIG. 7 will be modified so that contactors 29 and 39 are arranged in parallel whereby the first of the contactors to establish the connection 36–37 energizes relay 22. In an analogous manner, the schematic of FIG. 8 may be modified so that the contactors 29 and 39 would be arranged in series whereby the first of the contactors to establish the connection 36–37 cuts the circuit of relay 22.

For the departure gate according to the variant which has just been mentioned, there may be added a luminous barrier arranged according to what has already been described. In this case FIG. 10 will be modified so that the contactors 69 and 79 are arranged in parallel, with contactor 15 in series with said contactors 69 and 79. In the same manner, in the arrangement of FIG. 11, contactors 69 and 79 are arranged in series to which will be connected contactor 15 in parallel.

Finally, it will be noted that all the departure gates envisaged to the present with a luminous barrier provide only a single luminous barrier. It is however evident that several luminous barriers could be provided, one following the other and it would be then cutting the barrier situated the furthest down the course which would determine the starting of the chronograph.

The predetermined angle $\alpha$ which has been mentioned throughout this description and which is preferably chosen to be 30° is determined by practice. It is an angle of security which prevents the chronograph starting signal from being emitted at the least small displacement of the bar which can easily happen before the competitor makes his departure.

What I claim is:

1. A departure gate for sporting runs, said departure gate comprising:

first and second riser members disposed on first and second sides of a path, said riser members defining an outlet and a line of departure of a race course;

first and second devices mounted on said first and second riser members, respectively;

each of said devices including, a bar extending at least halfway over the width of said outlet, said bar being pivotally supported by its associated riser member and movable from a closed position aligned with said line of departure to an open position in the sense of said course when pushed by a contestant, an electro-mechanical contactor actuated by said bar as soon as said bar has traversed a predetermined angle $\alpha$; and, means responsive to each electro-mechanical contractor for producing a start signal only when both of said electro-mechanical contactors are actuated.

2. A departure gate as claimed in claim 1 wherein said predetermined angle is 30°.

3. A departure gate as claimed in claim 1 and further comprising means electrically coupled to said electro-mechanical contactors for producing a start signal only when both said bars have traversed said predetermined angle.

4. A departure gate as claimed in claim 3 wherein each said electro-mechanical contactor includes a pair of contacts which are closed when the bar which actuates the electro-mechanical contactor has traversed said predetermined angle, and means connecting the contacts of said electro-mechanical contactors in series.

5. A departure gate as claimed in claim 3 wherein each said electro-mechanical contactor includes a pair of contacts which are opened when the bar which actuates the electro-mechanical contactor has traversed said predetermined angle, and means connecting the contacts of said electro-mechanical contactors in parallel.

6. A departure gate as claimed in claim 3 and further comprising:

a luminous barrier positioned after said bars in the sense of said course, said luminous barrier comprising a luminous source fixed to said first device and a cell fixed to said second device;

a photo-electric contactor;

means connecting said cell to said photo-electric contactor whereby said photo-electric contactor is actuated when a contestant breaks said luminous barrier; and, means electrically connecting said photo-electric contactor in circuit with said electro-mechanical contactors and said means for producing said start signal whereby said start signal is produced only when actuation of said photo-electric contactor succeeds actuation of said electro-mechanical contactors.

7. A departure gate as claimed in claim 6 wherein said photo-electric contactor and said electro-mechanical contactors each include a pair of contacts which are closed when actuated, and means electrically connecting said contactors in series.

8. A departure gate as claimed in claim 6 wherein said photo-electric contactor and said electro-mechanical contactors each include a pair of contacts which are open when actuated, and means electrically connecting said contacts in parallel.

9. A departure gate as claimed in claim 1 and further comprising means electrically coupled to said electro-mechanical contactors for producing a start signal as soon as one of said bars has traversed said predetermined angle.

10. A departure gate as claimed in claim 9 and further comprising:

a luminous barrier positioned after said bars in the sense of said course, said luminous barrier comprising a luminous source fixed to said first device and a cell fixed to said second device;

a photo-electric contactor;

means connecting said cell to said photo-electric contactor whereby said photo-electric contactor is actuated when a contestant breaks said luminous barrier; and, means electrically connecting said photo-electric contactor in circuit with said electro-mechanical contactors and said means for producing said start signal whereby said start signal is produced only when the actuation of said photo-electric contactor succeeds actuation of said electro-mechanical contactors.

11. A departure gate as claimed in claim 3 and further comprising a chronograph and means for applying said start signal to said chronograph.

12. A departure gate as claimed in claim 9 and further comprising a chronograph and means for applying said start signal to said chronograph.

13. A departure gate for sporting runs, said departure gate comprising:

first and second riser members disposed on first and second sides of a path, respectively, said riser members defining an outlet and a line of departure of a race course;

first and second switch means;

first and second bars mounted on said first and second riser members, respectively, each bar being pivotally supported by its associated riser member and movable by a contestant from a closed position aligned with said line of departure to an open position whereat it actuates one of said switch means, each bar, in its closed position extending at least halfway over the width of said course; and, means responsive to said first and second switch means for producing a start signal only when both of said switch means are actuated.

14. A departure gate as claimed in claim 13 wherein each of said bars must traverse a predetermined angle $\alpha$ in moving from said closed position to said open position.

15. A departure gate as claimed in claim 13 and further comprising a chronograph and means for applying said start signal to said chronograph.

16. A departure gate as claimed in claim 14 wherein each said switch means includes a pair of contacts which are closed when the bar which actuates the switch means has traversed said predetermined angle, and means connecting the contacts of said first and second switch means in series.

17. A departure gate as claimed in claim 14 wherein each said switch means includes a pair of contacts which are opened when the bar which actuates the switch means has traversed said predetermined angle, and means connecting the contacts of said first and second switch means in parallel.

18. A departure gate as claimed in claim 14 and further comprising:

a luminous barrier positioned after said bars in the sense of said course, said luminous barrier comprising a luminous source fixed to said first device and a cell fixed to said second device;

a photo-electric contactor;

means connecting said cell to said photo-electric contactor whereby said photo-electric contactor is actuated when a contestant breaks said luminous barrier; and, means electrically connecting said photo-electric contactor in circuit with said first and second switch means and said means for producing said start signal whereby said start signal is produced only when actuation of said photo-electric contactor succeeds actuation of both said switch means.

19. A departure gate as claimed in claim 18 wherein said photo-electric contactor and said first and second switch means each include a pair of contacts which are closed when actuated, and means electrically connecting the contacts of both said switch means and said photo-electric contactor in series.

20. A departure gate as claimed in claim 18 wherein said photo-electric contactor and said first and second switch means each include a pair of contacts which are open when actuated, and means electrically connecting said contacts in parallel.

* * * * *